United States Patent [19]

Kling et al.

[11] Patent Number: 5,064,395

[45] Date of Patent: Nov. 12, 1991

[54] COMPACT OUTER JACKET FOR LOW WATTAGE DISCHARGE LAMP

[75] Inventors: Michael R. Kling, Stratham, N.H.; Thomas J. Gilligan, III, Salisbury, Mass.

[73] Assignee: GTE Products Corporation, Danvers, Mass.

[21] Appl. No.: 667,137

[22] Filed: Mar. 11, 1991

Related U.S. Application Data

[62] Division of Ser. No. 592,000, Oct. 1, 1990.

[51] Int. Cl.[5] ..... H01J 9/32; H01J 9/385

[52] U.S. Cl. ..... 445/27; 445/42; 445/43; 313/623; 313/626

[58] Field of Search ..... 445/26, 27, 42, 43, 445/44; 313/623, 626

[56] References Cited

U.S. PATENT DOCUMENTS

| | | | |
|---|---|---|---|
| 3,301,623 | 1/1967 | Preziosi et al. | 445/27 |
| 3,685,880 | 8/1972 | Sobieski | 445/26 |
| 4,631,446 | 12/1986 | English et al. | 313/634 |
| 4,734,612 | 3/1988 | Sasaki et al. | 313/15 |
| 4,891,555 | 1/1990 | Ahlgren et al. | 313/634 |

*Primary Examiner*—Kenneth J. Ramsey

*Attorney, Agent, or Firm*—William E. Meyer

[57] ABSTRACT

A compact arc discharge lamp may be formed with an inner lamp capsule and an outer envelope. One or more of the leads to the inner capsule may be sheathed to insulate the lead from improper arc over. The sheath may passed through the seal of the outer envelope, so the gas state of the intermediate volume may be adjust before final sealing.

12 Claims, 9 Drawing Sheets

COMPACT OUTER JACKET FOR LOW WATTAGE DISCHARGE LAMP

This is a division of co-pending application Ser. No. 07/592,000 filed on Oct. 1, 1990.

Basic aspects of this invention are disclosed in co-pending application COMPACT OUTER JACKET FOR LOW WATTAGE DISCHARGE LAMP, Ser. No. 07/592,000 filed by the present applicants on Oct. 1, 1990, and the benefit of the filing date of that application is hereby claimed for this divisional application.

TECHNICAL FIELD

The invention relates to electric lamps and particularly to arc discharge lamps. More particularly the invention is concerned with a double envelope arc discharge electric lamp.

BACKGROUND ART

Arc discharge lamps are being developed and evaluated for use in vehicles. Arc discharge lamps may last the life of a vehicle, while being more efficient than a filamented lamp. A major problem with arc discharge vehicle lamps vehicles is the needed to start the lamp quickly. After being switched off, and while still hot, the lamp must still be capable of being turned back on quickly. The residual hot gases in the lamp inhibit a restart arc, so restarting a hot lamp, generally requires a high voltage to jump the arc across the electrode gap. Restart voltages therefore may be 20,000 volts or more. Unfortunately, the high voltage intended to induce an arc inside the capsule, may improperly induce an arc between the leads outside the lamp capsule. The high starting voltages therefore make lead separation or lead insulation highly desirable. Overall capsule designs may help control the high voltages, such as double ended configurations and wide press single ended tubes where the lamp lead separations may be 2 or 3 centimeters. Double ended and wide seal lamps are inconvenient to integrate into a whole lamp design. On the other hand, single ended lamps are easier to mount in an optical design, safer, in that less wiring is used, easier to manufacture, and have a lower material cost; they are inherently harder to insulate with regard to interlead arc over. The side by side leads in a single ended lamp are a problem to insulate. There is then a need for a well insulated, single ended arc discharge lamp.

U.S. Pat. No. 4,734,612 issued to Hiroki Sasaki et al for High Pressure Metal Vapor Discharge Lamp on Mar. 29, 1988 shows as press sealed arc discharge lamp. One of the electrode leads is enclosed in glass and partially captured in the press seal

DISCLOSURE OF THE INVENTION

A compact arc discharge lamp may be formed having an inner lamp capsule to produce light from input electrical power, a first lead, extending from the inner lamp capsule, a second lead, extending from the inner lamp capsule, and a lead sheath, enclosing and electrically insulating a portion of the first lead. An outer envelope encloses the inner capsule to define an intermediate volume therebetween, and further encloses a portion of the first lead, a portion of the second lead and at least a portion of the lead sheath, and having an outer envelope seal capturing at least a portion of the lead sheath. The enclosed leads are then insulated with respect to each other. Additionally, the insulating sheath made be used as a duct to assist in regulating the gas state of the intermediate volume, or in supporting the enclosed capsule.

BEST MODE FOR CARRYING OUT THE INVENTION

To enhance lead insulation in a compact arc discharge lamp, the lead separation may be made longitudinally, along the lamp axis, rather than laterally across the press seal. A glass, or quartz sheath may cover all or portions of the inner lamp lead to prevent sodium migration and sodium loss in the arc tube. By extending the glass sheath through a press seal and continuing the glass sheath for a length sufficient to electrically insulate a substantial portion of the exterior lead, for example two or more centimeters, an economical, longitudinal separation may be formed. The longitudinal separation between the leads allows a smaller outer envelope to be made, for example an envelope with about a one centimeter outside diameter. The smaller outer envelope then has a corresponding material cost savings and is easier to fabricate.

A lead sheath may also be used as an exhaust tube for the intermediate volume formed between the inner capsule and outer envelope. The preferred exhaust tube location is through a press seal in the outer envelope. A necked tube or top tubulation locally distorts the light distribution, thereby creating an optical problem with stray light. A lamp with a tip-off requires a light blocking coating to control stray light. Tubulation involves extra manufacturing and increases the lamp cost. The optically preferred outer envelope is then smooth with no tip off or tubulation to cause distortion. An electrode lead may be extended through the press seal by way of a glass, or quartz sheath. The sheath exterior may be sealed to the press seal without closing the interior sheath passage. The intermediate volume between the inner capsule and the outer envelope may be exhausted and filled through the sheath passage. The sheath may be subsequently sealed by collapsing the sheath onto the lead wire threaded through the sheath.

Figure 1:
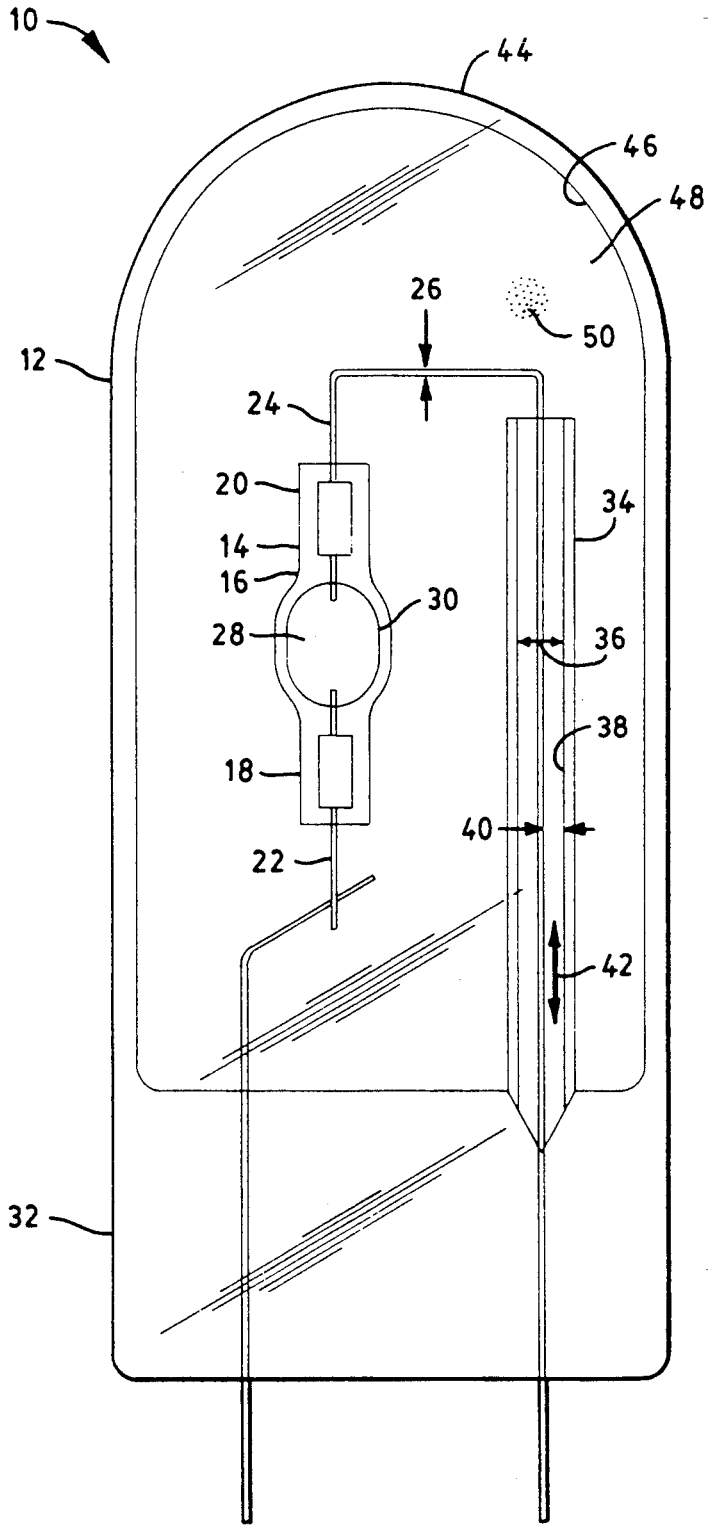
FIG. 1 shows a cross sectional view of a preferred embodiment of a compact double envelope arc discharge lamp.

FIG. 1 shows a preferred embodiment of a compact double envelope arc lamp 10. The compact double envelope lamp 10 may be assembled from an outer envelope 12 that encloses an inner lamp capsule 14. The inner lamp capsule 14 may have any suitable cross sectional configuration, such as a singled ended capsule. The preferred inner lamp capsule 14 is formed as a double ended lamp capsule 16 having a first seal end 18 and a second seal end 20. Extending from the first seal end 18 is a first lead 22, and extending from the second seal end 20 is a second lead 24 with an outer diameter 26. Enclosed in the body of the inner lamp capsule 14 is an inner volume 28 with a lamp fill 30 excitable to a light emissive state on the application of sufficient electric power through the first lead 22 and second lead 24. The sufficiency of electric power depends on the lamp's specific state, and in most arc discharge lamps, a hot restrike requires a high starting voltage pulse.

The first lead 22 may extend directly to a seal 32 through the outer envelope 12. The second lead 24 may extend to a tubular sheath 34 with an inner diameter 36, inner surface 38 defining an inner passage 42. The second lead 24 then extends through the inner passage 42 to the outer envelope 12 and through the seal 32.

The outer envelope 12 may be formed from a light transmissive material moldable at an elevated temperature to be sealable with the first lead 22; and second lead 24 or sheath 34. The outer envelope 12 in the preferred embodiment has a tubular form with an outer surface 44, and an inner surface 46 defining an enclosed intermediate volume 48. The outer envelope material may be made of an molybdenum sealing hard glass such as aluminosilicate. A sealing glass further simplifies construction by sealing directly to the second lead 24.

In the preferred embodiment, the first lead 22 extends away from the double ended inner capsule 14, and passes directly through the seal 32. The second lead 24 may extend away from the inner capsule 14 from an opposite end, and may be bent back, adjacent but offset from the inner capsule 14. The preferred positioning for the second lead 24 is on a side of the inner capsule 14 away from the first lead 22. In one embodiment, captured in the press seal 32 is an end of the insulated sheath 34, thereby insulating a substantial portion of the second lead's length as the second lead 24 extends through the intermediate volume 48. The second lead 24 may also extend away from the inner capsule 14 and pass through the outer envelope 12 seal 32.

The second lead 24 may, but need not, be immediately sealed to the outer envelope 12 seal 32 (FIG. 1). By way of example, the second lead 24 is shown as a straight metal wire sealed in the seal 32, but two wires of different materials, or of different diameters, or the typical wire and foil seal structure may be used in the alternative. Other suitable seal configurations may be used.

FIG. 1 also shows, positioned around the second lead 24, a lead sheath 34. The lead sheath 34 may be formed from an electrically insulating material, thermally and chemically compatible with the outer envelope 12 and the second lamp lead 24. A glass, or quartz tube is suggested for use as the lead sheath 34. Alternatively a ceramic sheath 34 might be used if the ceramic may be sealed to the second lead 24. Using the same material as the outer envelope is suggested to assure compatibility. The tubular sheath 34 then has an inner diameter 36 defined by an inner surface 38.

The second lead 24, from a point near the second seal end 20 of the inner lamp capsule 14, may extend through the intermediate volume 48, to an open end of the sheath 34. In one embodiment, the second lead 24 has a somewhat smaller outer diameter 26 than the inner diameter 36 of the lead sheath 34, so the second lead 24 may be threaded through the lead sheath 34 during lamp assembly. With the second lead 24 threaded through the sheath 34, between the second lead 24 and the inner surface 38 of the lead sheath 34 a gap 40 is formed. The gap 40 extends the length of the lead sheath 34 and thereby forms a passage 42 running adjacent the second lead 24 for the length of the lead sheath 34. The passage 42 may be sufficiently large to allow a gas to pass through the formed passage 42. Where no gases are intended to be passed through the passage 42, the lead diameter 26 may approach the sheath diameter 36 thereby closing down the passage 42 and easing the final sealing.

Figure 2:
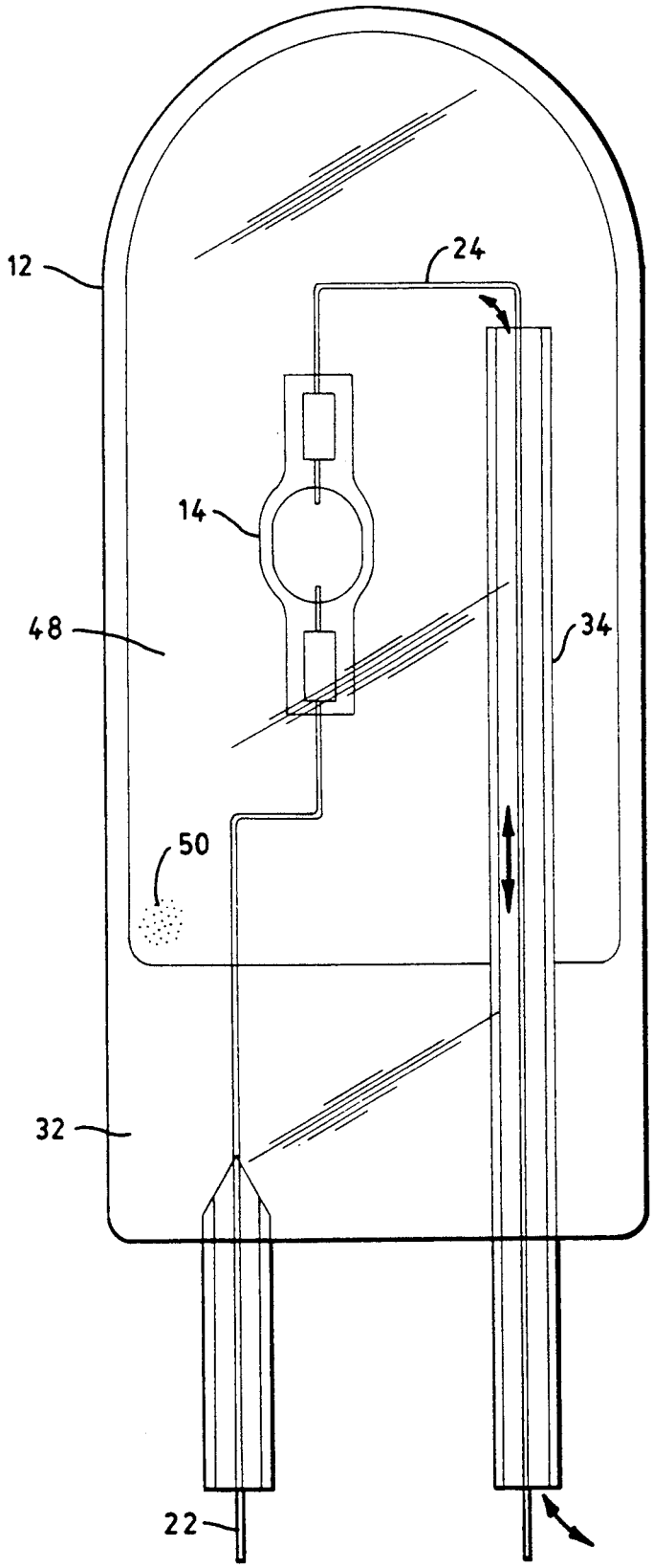
FIG. 2 shows a cross sectional view of an alternative embodiment of a compact double envelope arc discharge lamp with an insulation sheath extended through the press seal prior to final sealing.
Figure 3:
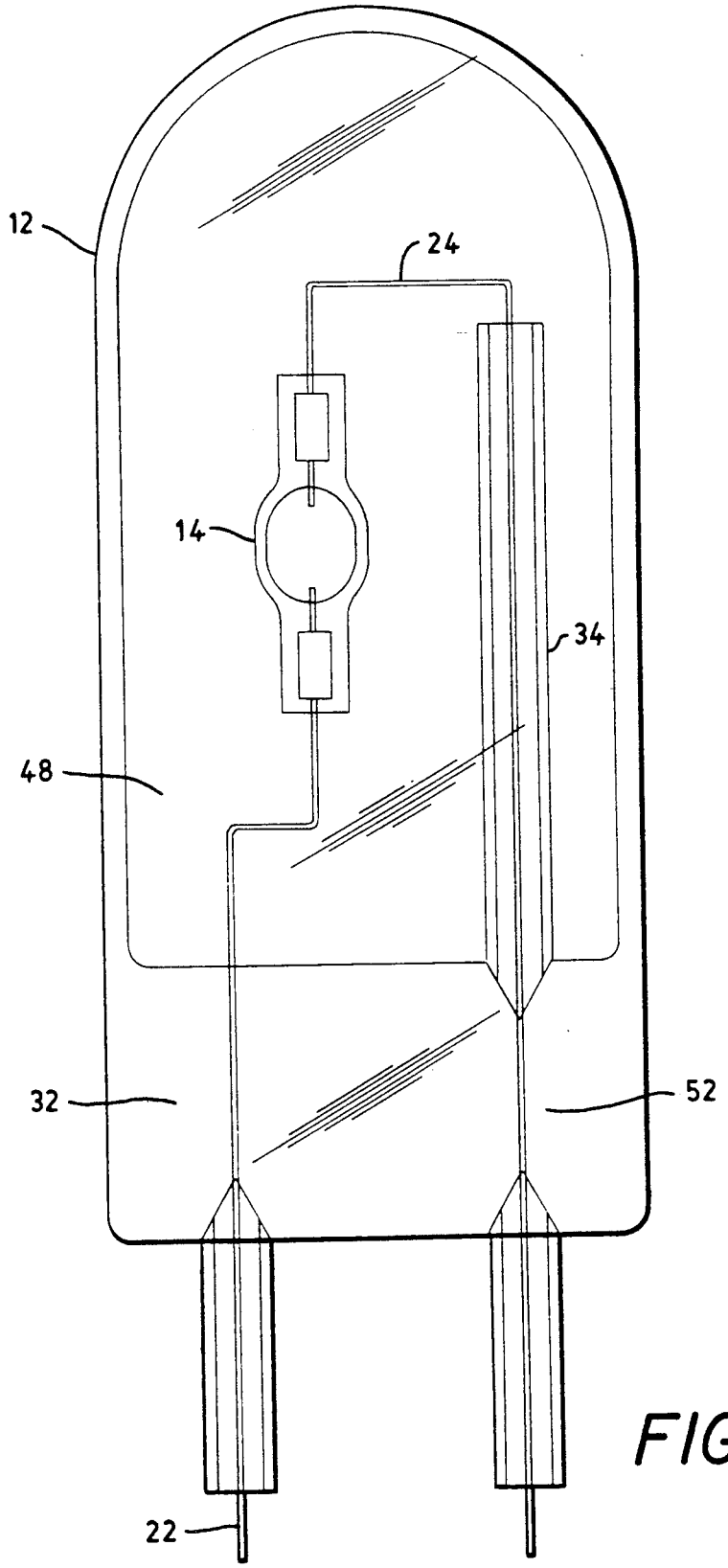
FIG. 3 shows a cross sectional view of an alternative embodiment of a compact double envelope arc discharge lamp with an insulation sheath extended through the press seal after final sealing in the press seal.
Figure 4:
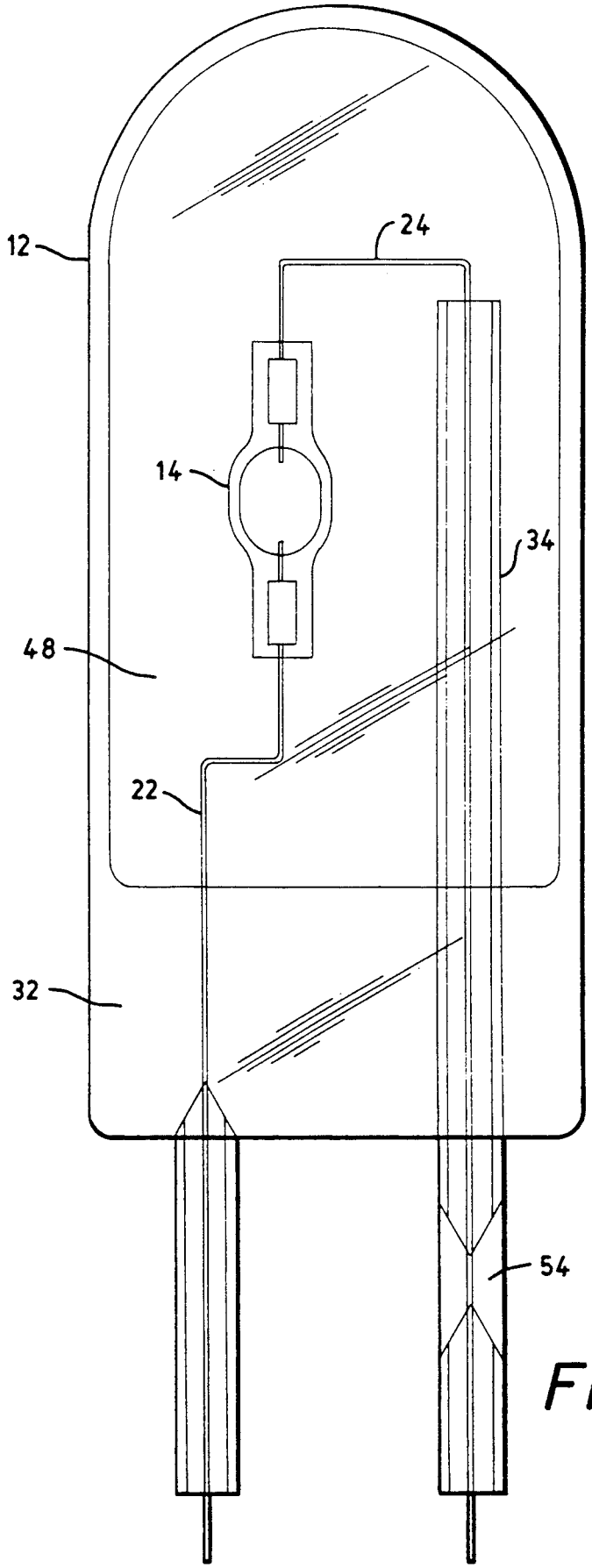
FIG. 4 shows a cross sectional view of an alternative embodiment of a compact double envelope arc discharge lamp with an insulation sheath extended through the press seal after final sealing exterior to the press seal.
Figure 6:
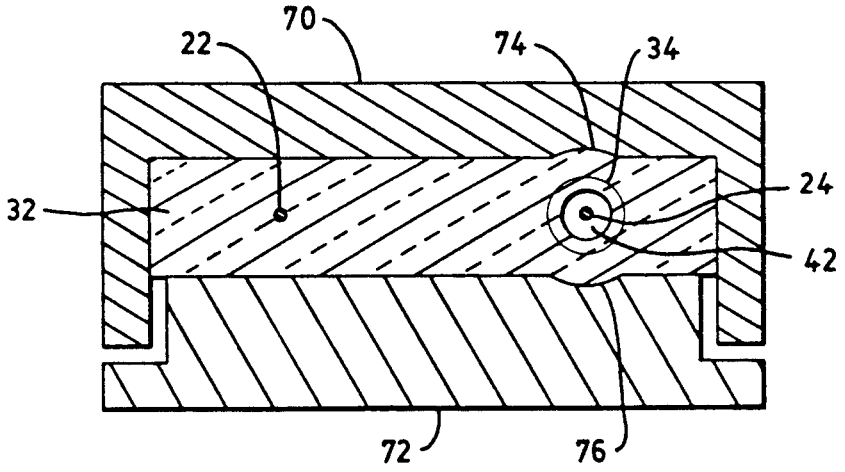
FIG. 6 shows a cross sectional view of two press heads in cross section showing reliefs formed to accommodate a sheath in a press seal.

The double ended inner lamp capsule 14, a portion of the first lead 22, a portion of the second lead 24, and a portion of the lead sheath 34 are positioned in the outer envelope 12. In the preferred embodiment, the first lead 22, and the second lead 24 extend through the seal 32. A portion of the lead sheath 34 may be captured in the outer envelop seal 32 (FIG. 1), or alternatively may extend through the seal 32 and beyond (FIG. 2). The outer envelope seal 32 may be raised to a temperature sufficient to make the seal 32 material pliable. The outer envelope 12 may be pressed or otherwise sealed to and around the first lead 22, and the captured end of the lead sheath 34 (FIG. 1) or the captured length of the lead sheath 34 (FIG. 2). Press heads may be designed with notches or reliefs in the press head faces adjacent the sheath 34 position, so the press heads do not crush the sheath 34 during the pressing operation. FIG. 6 shows two press heads 70, 72 in cross section showing reliefs 74, 76 formed to accommodate the sheath 34 in a press seal. The lamp capsule is then enclosed in the outer envelope 12 except for the sheath passage 42 (FIG. 2).

Where the lead sheath 34 extends through the press seal 32, a vacuum may be applied to the exposed end of the lead sheath 34 to withdraw from the intermediate volume 48 any gases 50 enclosed therein. Arrows indicate the flow in FIG. 2. Fill or flush gases 50 may then be sent through the lead sheath 34 passage 42 to refill the intermediate volume 48. The gases 50 may then be cycled in and out until an acceptable gas state exists in the intermediate volume 48. The outer envelope seal 32 adjacent where the lead sheath 34 passes, may be heated to a pliable state. The lead sheath 34 in the same region may be similarly brought to a pliable state. The outer envelope 12, and the lead sheath 34 may then be sealed to the second lead 24, thereby closing off the intermediate volume 48 (FIG. 3). Alternatively, the second lead 24, and the lead sheath 34 may be sealed exteriorly to the press seal 32 (FIG. 4). In two preferred embodiments, the intermediate volume 48 is finally left as a vacuum or is filled with nitrogen.

By coupling the sheath 34 through the press seal 32, the vacuum or gas state of the intermediate volume 48 may be adjusted after a substantial portion of the press seal 32 is formed. The sheath 34 may be subsequently sealed to the second lead 24 by heating at least a portion of the press seal 32 and pressing the tube to the enclosed second lead. FIG. 3 shows an alternative embodiment of a compact double envelope arc discharge lamp with the insulation sheath 34 extended through the press seal 32 and then sealed in the press seal 32 at seal 52. Alternatively, an exterior portion of the second lead 24 may be sealed separately to an exterior portion of the sheath 34 at seal 54. FIG. 4 shows an alternative embodiment of a compact double envelope arc discharge lamp with the insulation sheath extended through the press seal 32 and then sealed 54 exterior to the press seal.

Figure 5:
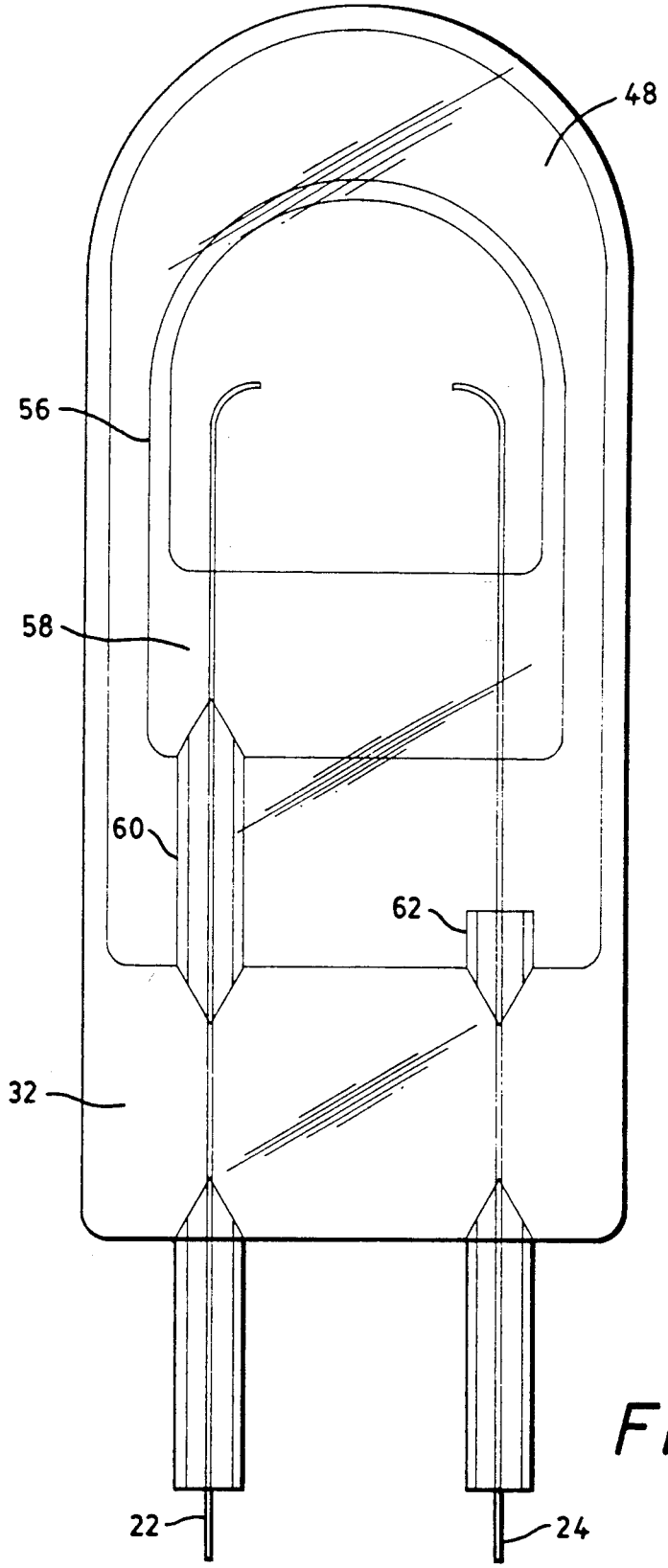
FIG. 5 shows a cross sectional view of an alternative embodiment of a compact double envelope arc discharge lamp with a single ended inner capsule.

FIG. 5 shows an alternative embodiment of a compact double envelope arc discharge lamp with a single ended inner capsule. While the preferred embodiment for the inner capsule is a double ended capsule, a single ended capsule 56 with a single inner press seal 58 may be used. Pressed in both the inner press seal 58, and the outer press seal 32 may be a sheath 60 for the first capsule lead 22. Similarly, a second sheath may extend through the outer press seal 32 to open on the intermediate volume allowing the intermediate volume 48 gas state to be adjusted before final sealing.

The assembly of a double envelope arc discharge lamp 10 with an insulating sheath, may be performed the following steps. The first step is to form an arc discharge inner capsule 14 with a first lead 22 and second lead 24. The inner capsule 14 is preferably double ended, but may be single ended. The next step is to position one or both leads in a lead sheath. For example, the second capsule lead 24 may be positioned through a lead sheath 34. The lead sheath 34 should be formed as a tube from an insulative material made pliable with the application of heat. An outer envelope 12 is then positioned around the lamp capsule 14 with its leads 22, 24, the one or both of which is (are) threaded in the lead sheath 34 or sheaths as the case may be. The outer envelope 12 is made of a light transmissive material, having a sealing area pliable on the application of sufficient heat. Glass and quartz are materials known in the lamp arts for making outer envelopes. The outer envelope 12 is positioned around inner lamp capsule 14, so the first lead 22, and the second lead 24 positioned in the lead sheath 34 extend into or through a seal 32 of the outer envelope 12. Depending on the need to adjust the gas state of the intermediate volume after initial sealing the sheath 34 passes through the seal 32. Next, the seal 32 is heated along the seal 32 to a pliable state. Gas flames are commonly used to heat glass and quartz to a pliable state. The heated seal 32 is then sealed to the adjacent lead and the lead sheath or sheaths as the case may be. For lamps where only an interior lead insulation is sought, and the sheath need not pass through the seal 32, so the lamps are complete.

In the embodiments where access to the intermediate volume 48 are sought, a press seal mechanism having press heads 70, 72 notched 74, 76 in the region of the lead sheath 34 is suggested. FIG. 6 shows two press heads 70, 72 in cross section showing reliefs 74, 76 formed to accommodate a sheath in a press seal 32. The method of sealing the exhaust tube in the press seal may be accomplished by forming circular or elliptical reliefs 74, 76 in the press feet 70, 72 adjacent the exhaust tube location. The press then forms the pliable outer envelope 12 around the first lead 22, and the sheath 34 without crushing the sheath 34. The relieved press heads 70, 72 may be used with a cooling flush gas circulating through the sheath 34 during the press sealing operation. Circulating a cooling gas in the sheath 34 helps keep the sheath 34 hard, and therefore open during pressing. Sealing the outer envelope 12 to the lead sheath 34 leaves a passage 42 through the lead sheath 34 adjacent the second lead 24. The passage 42 extends between the intermediate volume 48 and the exterior. Gases may be cycled back and forth through the passage 42, or a vacuum may be applied to remove a substantial portion of the gas held in the intermediate volume 48. Cycling gas through the passage 42 allows the gas or vacuum state of the intermediate volume 48 to be adjusted as the user desires. The seal 32 adjacent the lead sheath 34, and the lead sheath 34 may then be heated to a pliable state, and sealed to the second lead 24 by standard press sealing or vacuum sealing. Alternatively, the lead sheath 34 may be sealed exteriorly to the seal 32. Sealing the lead sheath 34 to the enclosed second lead 24 then closes off the intermediate volume 48 and preserves the gas or vacuum state established in the intermediate volume 48.

If further electrical insulation is required, or a shorter lead extension desired, a second sleeve may be used on the first lead 22. The second sheath may be sealed to the outer envelope 12 in a similar manner, however there is no need to leave a similar passage 42 opening for lamp exhaust. A second passage of course enhances gas circulation. The preferred alternative is to seal the second sheath to a press seal of the inner capsule, and extend the sheath into or through the outer envelope seal.

Figure 7:
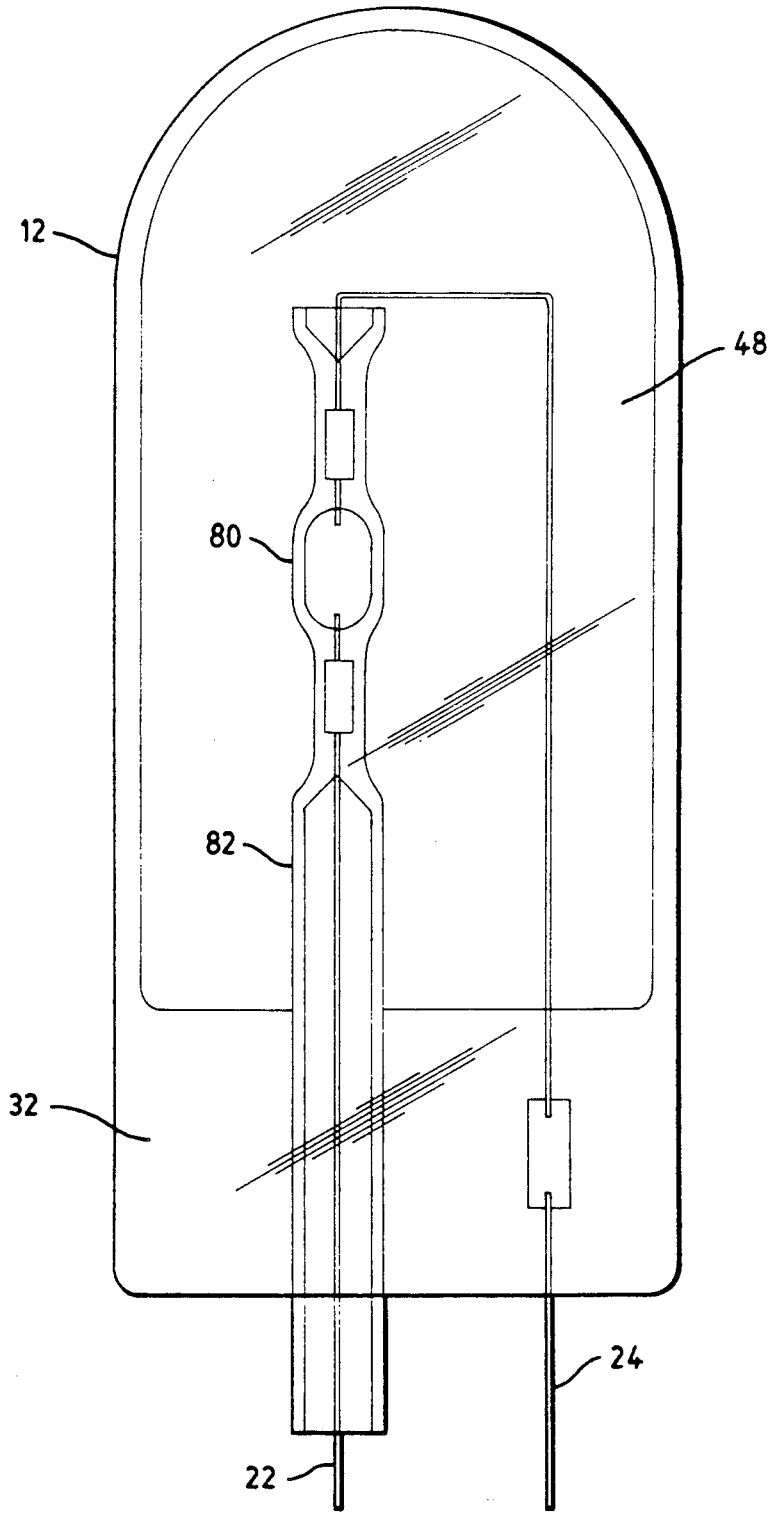
FIG. 7, 8, and 9 show cross sectional views of alternative embodiments of compact double envelope arc discharge lamps each with a double ended inner capsule with one end extending as an insulating sheath through a press seal.
Figure 8:
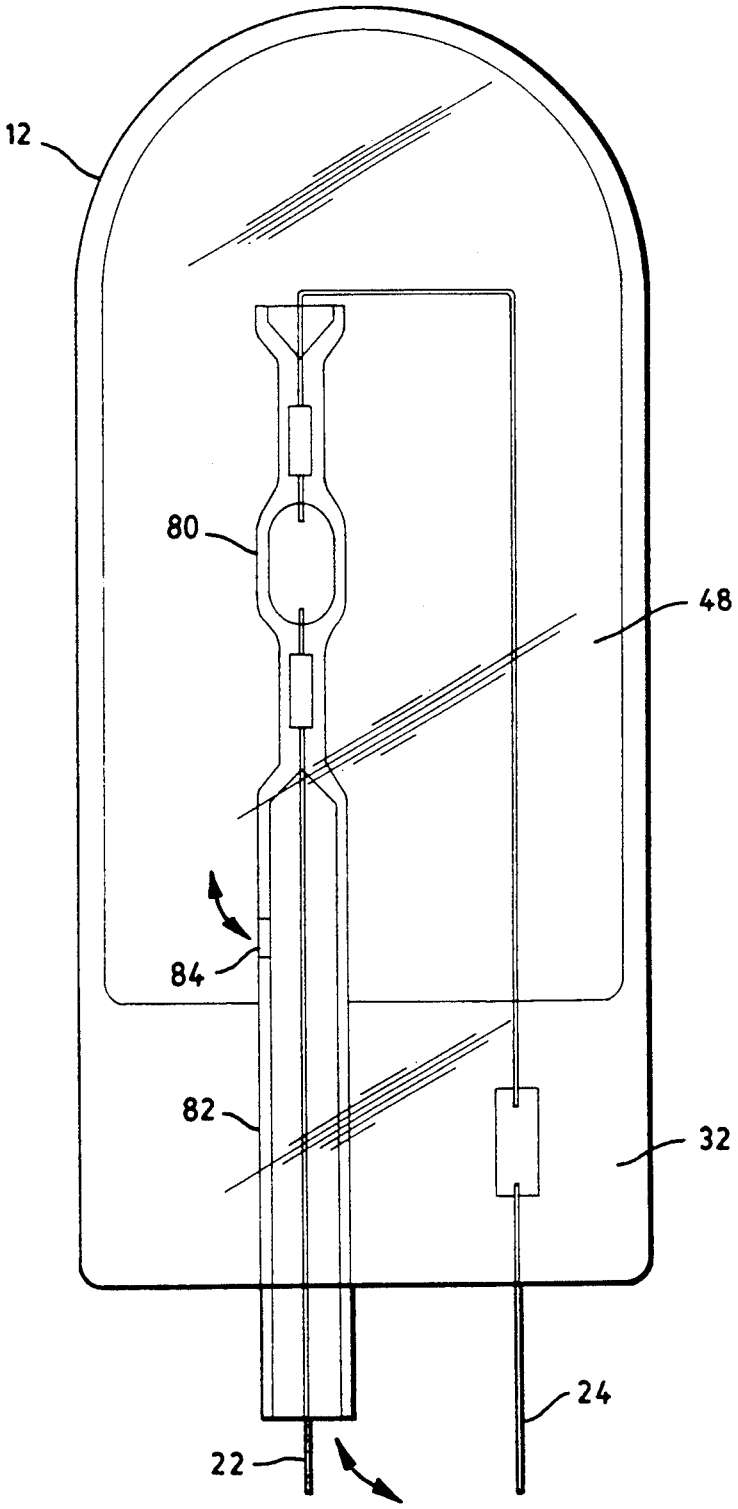
Figure 9:
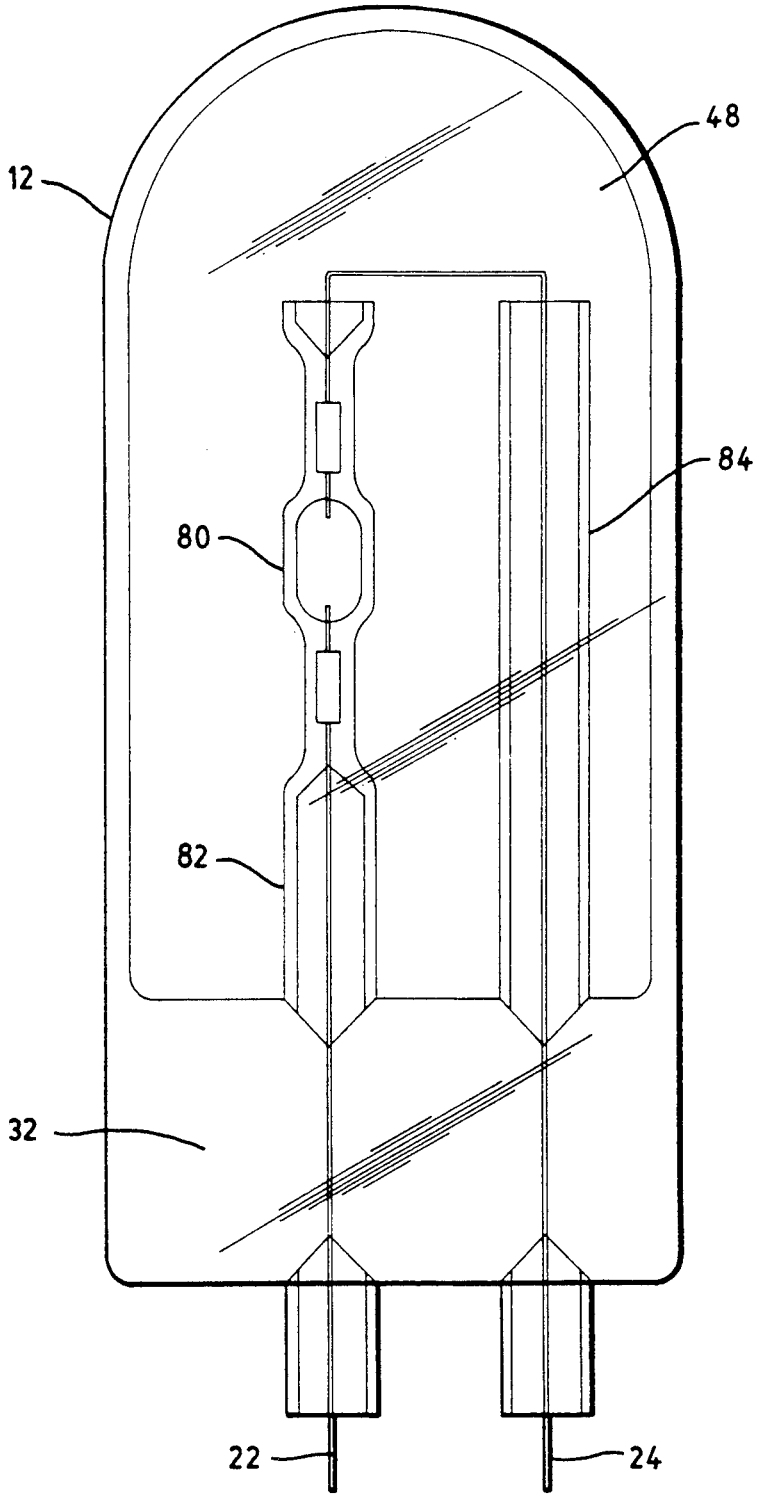

FIGS. 7, 8, and 9 show cross sectional views of alternative embodiments of compact double envelope arc discharge lamps each with a double ended inner capsule with one end extending as an insulating sheath through a press seal. A doubled ended arc discharge capsule may be formed from a tube with one end extending as a sheath over one of the leads. FIG. 7 shows a doubled ended capsule 80 with one end 82 extending through the press seal 32 of an outer envelope 12, thereby acting as a sheath for the first lead 22 inside the outer envelope. The second lead 24 may extend directly through the intermediate volume 48 to pass through the press seal 32. By choosing the outer envelope material to match the thermal expansion of the double ended capsule, the outer envelope 12 and the inner capsule 80 may be joined. Alternatively, the double ended capsule 80 with the extended end 82 acting as a sheath may include a side hole 84 along the sheath portion. With the capsule 80 positioned in and preliminarily sealed to the outer envelope 12, the inner passage of the capsule may be used as as a flush, or exhaust passage for the enclosed volume. The inner passage may then be sealed, either in the press seal area, or exteriorly, as described above. In still another variation, the first lead 22 may be shielded by an extension of a double ended capsule 80, and the second lead 24 may be shielded by a separate lead shield 84. Forming press heads to preliminarily seal and then finally seal the outer envelope and the capsule extension 82 or sheath 84 penetrating some or all of the outer envelope press seal 32 is thought to be with the ability of those skilled in the art of press seal design.

Press sealing two high voltage leads in a single ended lamp may place the emerging lamp leads close together leading to possible arc over outside the lamp. A booted electrical connection similar to that used on automobile spark plugs may be used to continue the lamp lead insulation, particularly where exposure to dirt, moisture, and salt can lower the arc-over resistance. The wires from the lamp ballast or the whole ballast may be fitted with boots made of silicon or a similar high breakdown insulator that fits over and seals the outer lead extensions. The insulated sheath may be coupled to a lamp base to provide additional support for the extensions. For example, instead of glass extensions, the base may have recesses for the boots preventing sideways forces on the glass sleeves. A recessed boot construction simplifies the connection and increase reliability. It is also much safer than other connection schemes where live conductors may be inadvertently exposed. Even with the lamp unplugged, the contacts are fairly inaccessible.

In a working example some of the dimensions were approximately as follows: The outer envelope had an outside diameter of 12.7 millimeters (0.5 inch). The intermediate volume had a length of about 38.1 millimeters (1.5 inch). The overall length was 47.625 millimeters (1.875 inch), and an overall volume of about 4.096 cubic centimeters (0.25 $inch^3$). The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of forming a double envelope arc discharge lamp formed by performing the steps of:

a) forming an inner lamp capsule with a first lead and a second lead, b) positioning the second lead through an insulative, tube formed of a material made pliable with the application of heat, c) positioning the inner lamp capsule in an outer envelope with the first lead, and the second lead positioned in the lead sheath extending through a seal area, d) heating the seal area of the outer envelope to a pliable state, e) sealing the seal area of the outer envelope to the first lead and the lead sheath leaving a passage through the lead sheath adjacent the second lead extending between the intermediate volume and the exterior, f) cycling gas through the lead sheath passage and out of the intermediate volume, and g) sealing the lead sheath passage.

2. The method in claim 1, wherein the lead sheath passage is sealed by heating a portion of the press seal, and lead sheath to pliability, and pressing the press seal to the second lead and lead sheath to closed the lead sheath passage.

3. The method in claim 1, wherein the lead sheath passage is sealed by heating a portion of the lead sheath exterior to the outer envelope to pliability, and pressing the lead sheath to the second lead to closed the lead sheath passage.

4. The method in claim 1, wherein the lead sheath passage is sealed by heating a portion of the press seal, and lead sheath to pliability, while evacuating the sheath passage to thereby vacuum seal the second lead and lead sheath to closed the lead sheath passage.

5. The method in claim 1, wherein the lead sheath passage is sealed by heating a portion of the lead sheath exterior to the outer envelope to pliability, while evacuating the sheath passage to thereby vacuum seal the second lead to closed the lead sheath passage.

6. A method of forming a double envelope arc discharge lamp formed by performing the steps of:

a) forming a double ended inner lamp capsule with a first lead and a second lead, having one end of the capsule extending over the first lead as a sheath, b) positioning the inner lamp capsule in an outer envelope thereby defining an intermediate volume between the capsule and envelope, with the first lead positioned in the lead sheath, the sheath and the second lead extending through a seal area of the envelope, c) heating the seal area of the outer envelope to a pliable state, d) sealing the seal area of the outer envelope to the second lead and the lead sheath.

7. The method in claim 6, further including the steps of a) forming a hole through a side of the sheath to leave a passage through the lead sheath adjacent the first lead extending between the intermediate volume and the exterior, b) cycling gas through the lead sheath passage to the intermediate volume to achieve a desired state in the intermediate volume, and c) sealing the lead sheath passage to the first lead exteriorly of the formed hole.

8. The method in claim 6, further including the steps of positioning the second lead through a second sheath formed of a material made pliable with the application of heat, heating the second sheath, and sealing the second sheath in the envelope seal area.

9. The method in claim 6, wherein the lead sheath passage is sealed by heating a portion of the press seal, and lead sheath to pliability, and pressing the press seal to the first lead and lead sheath to closed the lead sheath passage.

10. The method in claim 6, wherein the lead sheath passage is sealed by heating a portion of the lead sheath exterior to the outer envelope to pliability, and pressing the lead sheath to the first lead to closed the lead sheath passage.

11. The method in claim 6, wherein the lead sheath passage is sealed by heating a portion of the press seal, and lead sheath to pliability, while evacuating the sheath passage to thereby vacuum seal the first lead and lead sheath to closed the lead sheath passage.

12. The method in claim 6, wherein the lead sheath passage is sealed by heating a portion of the lead sheath exterior to the outer envelope to pliability, while evacuating the sheath passage to thereby vacuum seal the second lead to closed the lead sheath passage.

* * * * *